United States Patent [19]

Swain

[11] 4,242,936

[45] Jan. 6, 1981

[54] AUTOMATIC RHYTHM GENERATOR

[75] Inventor: Richard S. Swain, Niles, Ill.

[73] Assignee: Norlin Industries, Inc., Deerfield, Ill.

[21] Appl. No.: 75,831

[22] Filed: Sep. 14, 1979

[51] Int. Cl.[3] ..... G10H 1/42; G10H 7/00

[52] U.S. Cl. ..... 84/1.03; 84/DIG. 11; 84/DIG. 12

[58] Field of Search ..... 84/1.03, 1.24, DIG. 11, 84/DIG. 12

[56] References Cited

U.S. PATENT DOCUMENTS

| | | | |
|---|---|---|---|
| Re. 29,144 | 3/1977 | Bunger | 84/1.03 X |
| 3,743,755 | 7/1973 | Watson | 84/1.03 X |
| 3,958,483 | 5/1976 | Borrevik et al. | 84/1.03 |
| 4,010,667 | 3/1977 | Kniepkamp | 84/1.03 |
| 4,120,225 | 10/1978 | Dietrich et al. | 84/1.03 |
| 4,127,048 | 11/1978 | Schmoll | 84/1.03 |
| 4,135,423 | 1/1979 | Gross | 84/1.03 |
| 4,138,918 | 2/1979 | Kato | 84/1.03 |
| 4,163,407 | 8/1979 | Solender | 84/1.03 |
| 4,186,639 | 2/1980 | Robinson et al. | 84/1.03 |

*Primary Examiner*—S. J. Witkowski

*Attorney, Agent, or Firm*—Ronald J. Kransdorf; Jack Kail

[57] ABSTRACT

An automatic rhythm generator for use in an electronic organ is made more efficient, from the standpoint of rhythm pattern storage, by use of a zero suppression technique. Null instructions, the sole function of which is to allow a clock interval to pass without sounding an audible beat, are eliminated entirely from storage, and thus do not consume any memory capacity. In order to skip the necessary silent clock intervals before the next audible beat, each beat instruction which is stored at a memory address may include an encoded skip instruction commanding a number of clock intervals to be skipped before passing on to the next beat instruction at the next memory address. Alternatively, the skip instruction, in a stored program instrument, may come from software. In either case, the skip instruction controls a programmable frequency divider, which causes clock interval skipping by dividing down the clock frequency to a lower rate before it reaches the memory address counter. The number of clock intervals skipped, for a frequency division ratio of n, is n−1. Thus, a frequency division ratio of one causes zero clock intervals to be skipped. A maximum frequency division ratio of four, encoded in a two-bit word, skips three clock intervals, which is adequate for all practical situations.

13 Claims, 3 Drawing Figures

AUTOMATIC RHYTHM GENERATOR

BACKGROUND OF THE INVENTION

This invention relates generally to electronic musical instruments, such as organs. It specifically concerns methods and circuits employed in such instruments for the purpose of automatically generating a rhythm accompaniment.

This invention is an improvement in a prior art automatic rhythm generation technique which employs a read-only memory (ROM) to store a rhythm pattern consisting of a set of individual rhythm beat instructions to be executed in a predetermined sequence. These instructions are stored at memory addresses in numerical order according to the desired sequence of instruction execution. An address counter is stepped consecutively through a series of numerical states, to select a series of numerically consecutive memory addresses, thus reading the instructions out of the memory in the proper order for execution. The tempo of the rhythm is determined by a rhythm clock which steps the address counter through its sequence of states at a selected regular pace.

A problem arises with the above-described technique, however, whenever a particular rhythm pattern has irregular spacing between the audible beats. Under those circumstances some pairs of consecutive beats will be heard in consecutive clock intervals, while other pairs of consecutive beats will be separated by one or more silent clock intervals, during which the rhythm pattern calls for no audible beat to occur. With the above-described technique, this situation can only be handled by storing zeros (null instructions) at those memory addresses which correspond, in the timing sequence, to beatless clock intervals. Then the rhythm clock will cause the counter to address one or more empty memory locations before eventually reaching the address at which the next sequential audible beat instruction is stored.

This system works well, but is wasteful of memory space. Such waste is expensive if it necessitates the use of a larger capacity ROM chip. Alternatively, if the capacity of the ROM chip is held down to avoid expense, then the number of rhythm patterns which can be contained in a device of given capacity is smaller, because of the need to "store " null instructions.

BRIEF SUMMARY OF THE INVENTION

The present invention seeks to avoid this trade-off between expense and capacity, by eliminating the need for storing empty instructions. The invention employs means for controlling the rate at which the address counter is incremented by the rhythm clock, so that a predetermined number of rhythm clock intervals (ranging from zero to some positive whole number) must elapse before allowing the rhythm clock to increment the address counter to select the next memory address. In a preferred embodiment, a frequency divider of the programmable type is used, so that different frequency division ratios can be selected at different times in response to different control inputs. Various control inputs are then applied to select the number of silent clock intervals.

If the control input commands a frequency division ratio of one, then the rhythm clock frequency is not divided down to a lower frequency at all. It is passed through the frequency divider unchanged, the address counter is advanced one numerical address per clock interval, and a new memory address is accessed for each such interval. The number of skipped clock intervals is thus zero, and the next beat instruction will be executed immediately after the present one.

But if the control input commands a frequency division ratio of two, then the rhythm clock frequency is divided in half, and two clock intervals will be required to advance the address counter to the next numerical state. Hence, the very next clock interval will be skipped, and during that time no new address will be selected. By the second clock interval, however, the frequency divider is satisfied, and the addressing process is allowed to continue. If the programmed division ratio is three, then the number of skipped clock intervals is two, and so on. In general, for a division ratio of n, $n-1$ clock intervals are skipped.

In one implementation of the invention, each beat instruction stored in the ROM includes information about how many of the next consecutive clock intervals (if any) are to be empty, before the next audible rhythm beat occurs. This "skip" information, of course, increases the word length of each stored beat instruction, and thus would seem to exacerbate the memory capacity problem outlined above. But the additional storage requirement resulting from added word length is more than compensated by a reduction in the total number of beat instruction words which must be stored, owing to the elimination of all "empty" words.

The frequency divider control input is derived from the extra "skip" information which is included in each beat instruction stored in the ROM. Thus each memory address stores a word which not only gives the rhythm instruction to be executed during the present clock interval, but also controls the frequency divider to determine how many of the following clock intervals will be allowed to elapse before the next memory address is consulted for the next audible beat instruction.

Alternatively, if the musical instrument is one which is controlled by a stored program, the control input can be derived entirely from software.

The invention will now be described in greater detail in connection with the following drawings.

DETAILED DESCRIPTION OF THE PREFERRED EMBODIMENT

Figures 1, 2:
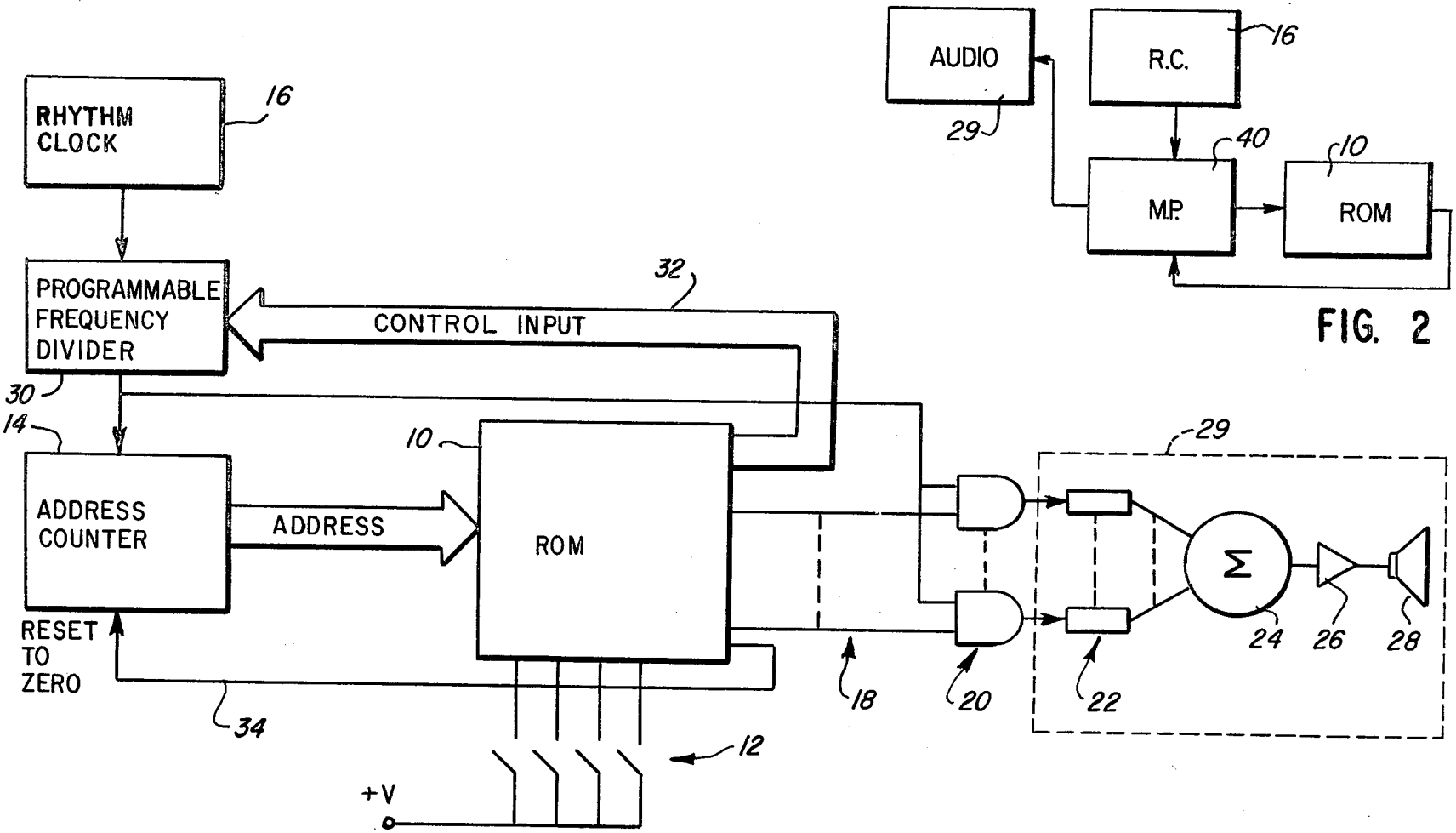
FIG. 1 is a functional block diagram of an improved automatic rhythm generator in accordance with this invention, for use with an electronic organ or other electronic musical instrument.
FIG. 2 is a functional block diagram of an alternative embodiment of the improved automatic rhythm generator.

The automatic rhythm generator depicted in FIG. 1 includes a rhythm pattern memory in the form of a ROM 10. The ROM is divided into a number of different address blocks, each of which stores a different rhythm pattern. For example, one such block stores a rumba rhythm, another one a waltz rhythm, and so. Each rhythm pattern is generated audibly for use as an accompaniment to a rumba melody, a waltz melody, etc. While the organist plays the melody manually, the organ circuitry depicted herein automatically plays the rhythm as an accompaniment.

In order to select a particular rhythm pattern, such as a rumba, waltz, etc., the organist closes one of several manually operable rhythm selector switches 12 to access the particular block of memory addresses in which the desired pattern is stored. The effect of closing one of the selector switches 12 is to determine the most significant digits of the desired memory address, thus focusing on a contiguous block of addresses which all have the same most significant address digits, and differ only in their less significant address digits.

Each such memory block contains a complete rhythm pattern. Each such pattern consists of a series of discrete rhythm instructions to be executed in a predetermined time sequence. Each such instruction is stored at its own individual memory address, differing in the least significant digits from every other address within the same memory block. The instructions are read out of the ROM in the proper sequence for execution by an address counter 14 which steps through a consecutive series of numerical states when driven by a clock 16 at a predetermined tempo. Each successive numerical state of the counter 14 selects a different set of least significant memory address digits within the particular block of memory addresses chosen by one of the selector switches 12. As the address counter progresses numerically, it accesses consecutively all of the addresses within the selected memory block, thereby reading out each consecutive rhythm instruction in proper sequence.

The consecutive rhythm instructions appear in the form of successive digital words in bit-parallel form on memory output lines 18. Each output bit, controlled by one of a set of AND gates 20, goes to one of several musical instrumentation circuits 22, such as clave, block, high drum, low drum, tom-tom, bass drum and cymbal. Whenever a "one" bit appears at the input to one of the musical instrumentation circuits 22, that particular circuit will be activated for one beat, producing a waveform which mimics a particular rhythm instrument. All the rhythm waveform outputs are then summed by a circuit 24, the sum output then being boosted by an amplifier 26 which drives a speaker 28 to produce an audible rhythm sound. Circuits 22 through 28 collectively form an audio output section 29.

As so far described, the automatic rhythm generator is entirely conventional. Without further modification, whenever a particular rhythm pattern called for none of the musical instrumentation circuits 22 to be activated during one or more rhythm clock intervals, it would be necessary to store a blank instruction word (all zeros) at each corresponding address of the memory 10. The present invention, however, compresses the data stored in the memory, eliminating null instruction words entirely, and incorporating all null beat information into the immediately preceding non-null beat instruction word.

In accordance with this invention, a programmable frequency divider 30 is interposed between the address counter 14 and the rhythm clock 16. As a result, the rate at which the counter 14 steps to successive memory addresses can be divided down to some integral fraction of the rhythm clock rate. The exact value of the division ratio depends upon the particular divisor for which the frequency divider circuit is set at any moment. The control input is a digital word of two or more bits arriving over a cable 32. A two-bit word is sufficient to encode four different division ratios; i.e. a range of from one to four.

The control input is taken from two or more of the output lines from the ROM 10. Two (or more, if necessary) bits of every rhythm beat instruction word stored at each memory address are used, not for activating the musical instrumentation circuits 22, but for controlling the frequency divider. If a particular beat instruction word is to be followed by three beatless (silent) intervals of rhythm clock 16, then the information on cable 32 encodes for a division ratio of four. As a result, it will take four rhythm clock intervals to step the address counter to its next state. Therefore, there will be three consecutive silent clock intervals (no beat sounded) before the address counter, in the fourth clock interval, is stepped to its next numerical state and the next sequential beat instruction word is accessed at the next sequential memory address.

In general, for any division ratio n, $n-1$ clock intervals are skipped, and the address counter 14 and memory 10 are reactivated only at the nth clock interval. If the division ratio is one, then there is no reduction in the stepping rate of the address counter 14, and the next address of memory 10 is accessed at the very next clock interval, without omitting any intervening clock intervals at all. If the number of bits on cable 32 is two, then the highest attainable frequency division ratio is four, and the largest number of consecutive clock intervals which can be skipped, before the memory 10 is addressed again, is three. Few, if any, rhythm patterns require more than three consecutive silent clock intervals before the next audible beat.

It will be appreciated that the function of programmable frequency divider 30 can be realized by various other circuit embodiments, the common feature of such circuit embodiments being their ability to selectively inhibit the application of clock pulses from rhythm clock 16 to address counter 14 in response to a control input on cable 32. For example, a counter which is clocked by the rhythm clock 16 and preset according to the bits on cable 32 may be used for this purpose. In this case, the counter would count rhythm clock pulses from the preset number down toward a count of zero. Upon reaching a zero count, a suitable gating circuit would couple a clock pulse for incrementing the address counter 14, and the next encoded preset instruction would be outputted on cable 32. It will be seen that the foregoing embodiment achieves the same result as frequency divider 30; namely, selectively inhibiting the application of rhythm clock pulses for incrementing the address counter 14.

The purpose of the AND gates 20 is to prevent repetition of an audible beat during the intervening silent clock intervals. The previous memory output is still available to the gates 20 during these silent intervals, because the address specified by counter 14 has not yet changed. But the memory output is allowed to reach the musical instrumentation circuits 22 only when the gates 20 are enabled by an output from the frequency divider 30. That output is available only during the particular interval of rhythm clock 16 when the frequency divider advances the counter 14 to select a new memory address. During all subsequent clock intervals, while the memory address remains unchanged because there is not yet any output from the frequency divider 30, the gates 20 will not be enabled.

Each time a complete repetition of the basic rhythm pattern is concluded, i.e. when the counter 14 has stepped through to the last address of the particular memory block containing that rhythm pattern, another bit in the instruction word strobes a reset line 34 which resets the address counter to zero, the lowest address of the block, so that the rhythm pattern can be repeated as long as needed.

Figure 3:
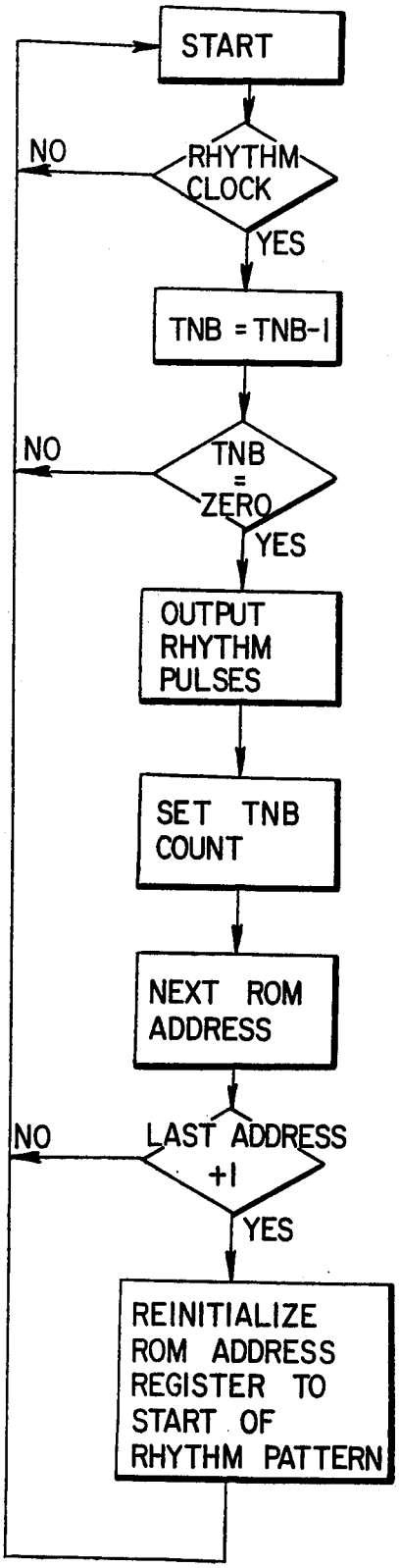
FIG. 3 is a program blow chart for use with the embodiment of FIG. 2.

In the alternative embodiment of FIG. 2, the zero suppression function is performed by microprocessor 40, which is a small scale but full-function general purpose stored-program digital computer shrunk to the size of a single integrated circuit chip. The microprocessor takes the rhythm tempo from the rhythm clock 16, and at a given clock time accesses an address of the ROM 10. As in the embodiment of FIG. 1, every consecutive address of the ROM 10 contains an audible rhythm beat instruction, plus an additional two or more bits indicating the number of clock times (in the range from zero to three or more) which must elapse before the next memory address is accessed and the next audible rhythm beat sounded. This information is fed back to the microprocessor 40, which is provided with appropriate software (in the form of an internally stored program) for carrying out the instructions received from the ROM. The program flow chart of FIG. 3 illustrates in general terms one possible sequence of program steps which will satisfy this requirement. The first microprocessor cycle (start) checks to see if the rhythm clock line is high. If not, the microprocessor keeps on checking until that line does go high. Then, when a rhythm clock pulse arrives, the next microprocessor cycle decrements by one a stored quantity TNB (time till next beat), which represents the last information received from the ROM as to how many clock times are to pass before the next beat instruction is fetched and sounded. Thus the decremented quantity (TNB−1) becomes the new TNB value, and is then compared to zero to see if the required number of clock times has elapsed yet. If not, the entire program cycle is restarted. But if TNB is now zero, then it is time for the next rhythm beat to be sounded, so the microprocessor fetches and outputs the rhythm instruction pulses which it finds in the next successive address of ROM 10. Thereafter, microprocessor performs several additional program steps which are necessary to prepare for the next audible beat. First, it takes the new TNB value (time till the new next audible beat) which comes along as part of the data just fetched from memory 10, and resets an appropriate internal register to that value, replacing the old TNB value (which either was zero initially or prior to this time had been decremented in unit steps down to zero). Then the microprocessor must also increment by one another internal register which keeps track of the current ROM address accessed; this new ROM address is the next one in numerical order, and contains the next audible beat instruction to be executed when the current TNB value goes to zero.

At this point the microprocessor must check to see if the new ROM address exceeds the last one in the particular rhythm pattern now being played. If not, there is at least one ROM address yet to be accessed, so the program cycle is repeated again from the beginning. But if the new ROM address is equal to the last address in that rhythm pattern plus one, then that means that the rhythm pattern has been concluded. If the organ keys call for the rhythm pattern to continue beyond this point, that can only be done by repetition of the pattern, which requires a return to the first memory address of the series which stores the pattern. Accordingly, under these circumstances the microprocessor resets the ROM address register to the first pattern address, and then re-enters the program loop at the beginning so that the rhythm sequence starts over.

In this embodiment the microprocessor 40 performs the function of the frequency divider 30 and address counter 14. The microprocessor receives the clock interval skip data from the ROM 10, and delays the execution of the next beat instruction for the indicated number of clock times by not outputting the beat instruction pulses to audio section 29 unless the TNB value is initially zero or until it has been reduced to zero by repeated decrementing at the rate of one per clock. All the hardware necessary for keeping track of the TNB and the current ROM address is standard equipment internal to the microprocessor 40 which operates under stored program (software) control in a manner analogous to the hard-wired functions carried out by the frequency divider 30 and address counter 14 of FIG. 1. In either case, the data stored in the memory 10 is the same: it is compressed to exclude all null (zero) beats, but includes in each beat instruction extra information for skipping the requisite number of clock intervals between consecutive memory addresses. This information forms the required control input to either the microprocessor of FIG. 2 or the frequency divider 30 of FIG. 1.

The choice between these two embodiments will depend largely upon cost considerations. If the microprocessor 40 is required for other reasons and has some program storage capacity left over from its other functions, the cost considerations may well favor its use for the purposes of this invention in preference to the special purpose hardware approach of FIG. 1.

It will now be appreciated that this invention entirely avoids the storage of null instruction words at "wasted" memory addresses in order to silence the audio circuits for one or more consecutive clock intervals between audible beats of a rhythm pattern. Instead, it achieves the desired silent intervals by using up clock intervals to count down the frequency divider or TNB while the address count, ROM, and audio output section are temporarily idled. The number of silent intervals, if any, is incorporated into the preceding audible beat instruction word; and this number can vary from one such word to another as required by the musical characteristics of any particular rhythm pattern. As a result, either a less expensive smaller ROM can be used to store any given number of rhythm patterns, or a larger number of rhythm patterns can be stored for any given size and cost of ROM. In either case, information is compressed through zero suppression, while storage density and cost effectiveness are substantially increased.

The particular embodiment disclosed, while preferred, is only one example of how the principles of this invention can be reduced to practice. Various other specific applications, all within the scope of the appended claims, may be imagined.

I claim:

1. An automatic rhythm generator comprising:

means developing a rhythm clock signal defining a sequence of rhythm clock intervals;

a memory storing a sequential set of rhythm instructions at a plurality of consecutive memory addresses, each of said rhythm instructions including an associated code representing a number of said rhythm clock intervals; and means for sequentially addressing said memory at a rate determined by the number of rhythm clock intervals represented by the code associated with the presently addressed memory address.

2. An automatic rhythm generator comprising:

means developing a rhythm clock signal defining a sequence of rhythm clock intervals;

a memory storing a sequential set of rhythm instructions at a plurality of consecutive memory addresses, each of said rhythm instructions including an associated code representing a number of said rhythm clock intervals; and means for sequentially addressing said memory, said addressing means being incremented for addressing each of said memory addresses in a time interval related to the number of rhythm clock intervals represented by the code associated with the presently addressed memory address.

3. In a method of automatically generating a sequential set of rhythm instructions including the steps of storing said rhythm instructions in respective memory addresses, selecting a series of said memory addresses by counting addresses, and advancing said address count by means of a rhythm clock, the improvement comprising the steps of:

selecting the number of rhythm clock intervals to elapse before incrementing said address count to the next memory address; and processing the rhythm clock output so as to allow said selected number of rhythm clock intervals to elapse before incrementing said address count to the next memory address;

whereby respective rhythm instructions which are to be executed in non-consecutive rhythm clock intervals may nevertheless be stored in consecutively selected memory addresses.

4. A method as in claim 3 wherein said controlling step comprises the step of dividing the rhythm clock output by a ratio so as to allow said selected number of rhythm clock intervals to elapse before incrementing said address count to the next memory address.

5. A method as in claim 3 wherein:

each of said rhythm instructions stored at respective memory addresses includes information as to the number of rhythm clock intervals which are to elapse before the next consecutive rhythm instruction in said sequential set is executed;

and a number of such intervals, ranging from zero to a positive integer, is allowed to elapse based on such information derived from the presently selected memory address, before the next memory address is selected.

6. A method as in claim 5 wherein each rhythm instruction is executed only in the first rhythm clock interval following the selection of the memory address containing said instruction, whereby to avoid repeating any rhythm instruction during any subsequent rhythm clock intervals prior to the selection of the next consecutive memory address.

7. A method as in claim 6 wherein, at the conclusion of said set of rhythm instructions, it is repeated in sequence as long as the rhythm to which it pertains is required.

8. In an automatic rhythm generator of the type having a memory for storing a sequential set of rhythm intructions in respective memory addresses, address counting means for specifying a predetermined series of said memory addresses, and a rhythm clock for advancing said address counting means to select successive addresses in said series, the improvement comprising:

means for selectively controlling the rate at which said address counting means is incremented by said rhythm clock, so that a predetermined number of rhythm clock intervals must elapse before said rhythm clock is allowed to increment said address counting means to select the next memory address in said series;

said controlling means being operable for assigning different values to said predetermined number at different times in response to different control inputs;

and means for providing various control inputs to said controlling means;

whereby respective rhythm instructions which are to be executed in non-consecutive rhythm clock intervals may nevertheless be stored at consecutively selected memory addresses.

9. An automatic rhythm generator as in claim 8 wherein said control input means is connected to derive its control input from the presently selected memory address, whereby the rhythm instruction at a given memory address specifies the number of rhythm clock intervals which are to elapse before the rhythm instruction at the next consecutively selected memory address is to be executed.

10. An automatic rhythm generator as in claim 8 wherein said controlling means comprises computing means programmed for selectively dividing the rate at which said address counting means is incremented by said rhythm clock in response to said control inputs.

11. An automatic rhythm generator as in claim 8 wherein said controlling means comprises a programmable frequency divider connected for selectively dividing the rate at which said address counting means is incremented by said rhythm clock in response to said control inputs.

12. An automatic rhythm generator as in claim 11 further comprising gating means at the rhythm instruction output of said memory, operable to permit execution of a rhythm instruction derived from a given memory address only in the first rhythm clock interval following the incrementing of said address counting means to select said given memory address, whereby to avoid repeating any rhythm instruction during any subsequent rhythm clock intervals prior to the next time said address counting means is incremented to select the next memory address.

13. An automatic rhythm generator as in claim 9 further comprising means for resetting said address counting means at the end of said predetermined series of memory addresses so as to return to the beginning of said predetermined series whereby to repeat the rhythm pattern.

* * * * *